US011391058B2

(12) United States Patent
Schuberth

(10) Patent No.: US 11,391,058 B2
(45) Date of Patent: Jul. 19, 2022

(54) ACTUATING HANDLE WITH BLOCKING DEVICE

(71) Applicant: HOPPE AG, Lana (IT)

(72) Inventor: Oliver Schuberth, Laas (IT)

(73) Assignee: HOPPE AG, Lana (IT)

( * ) Notice: Subject to any disclaimer, the term of this patent is extended or adjusted under 35 U.S.C. 154(b) by 740 days.

(21) Appl. No.: 16/224,349

(22) Filed: Dec. 18, 2018

(65) Prior Publication Data

US 2019/0218819 A1 Jul. 18, 2019

(51) Int. Cl.

| | |
|---|---|
| ***E05B 13/00*** | (2006.01) |
| ***E05B 15/02*** | (2006.01) |
| ***E05B 15/00*** | (2006.01) |
| ***E05B 35/00*** | (2006.01) |
| ***E05B 47/06*** | (2006.01) |

(52) U.S. Cl.
CPC ..... *E05B 13/002* (2013.01); *E05B 13/004* (2013.01); *E05B 15/02* (2013.01); *E05B 15/0053* (2013.01); *E05B 35/008* (2013.01); *E05B 47/0657* (2013.01); *Y10T 292/57* (2015.04); *Y10T 292/82* (2015.04)

(58) Field of Classification Search
CPC ..... E05B 13/002; E05B 13/004; E05B 15/02; E05B 15/0053; E05B 35/008; E05B 47/0657; Y10T 292/57; Y10T 292/82; Y10S 292/53; Y10S 292/54
See application file for complete search history.

(56) References Cited

U.S. PATENT DOCUMENTS 2,295,435 A * 9/1942 Teich ..... E05C 1/163 292/359
2,400,403 A * 5/1946 Falk ..... E05C 1/163 292/359
4,142,748 A 3/1979 Hook
(Continued)

FOREIGN PATENT DOCUMENTS

DE 10 2007 030 655 A1 1/2009
GB 3713 A 8/1915
(Continued)

*Primary Examiner* — Christine M Mills
*Assistant Examiner* — Faria F Ahmad
(74) *Attorney, Agent, or Firm* — Reinhart Boerner Van Deuren P.C.

(57) ABSTRACT

The invention relates to an actuating handle (100) for a door with an escutcheon (104) and a handle (102) for actuating a locking device arranged in the door. The handle (102) for actuating the locking device is mounted in the escutcheon (104) rotatably about a first axis of rotation. The actuating handle (100) moreover has a blocking device (106), having a release position in which a rotation of the handle (102) about the first axis of rotation is released, and a blocking position in which a rotation of the handle (102) about the first axis of rotation is blocked by the blocking device (106). The actuating handle (100) moreover has an actuating mechanism (112) for the blocking device (106). According to the invention, it is provided that the actuating mechanism (112) has a sliding element (108) which is displaceable along a circle segment centered around the first axis of rotation, wherein a displacement of the sliding element (108) along the circle segment brings about an actuation of the blocking device (106).

11 Claims, 5 Drawing Sheets

(56) References Cited

U.S. PATENT DOCUMENTS

Figure 1:
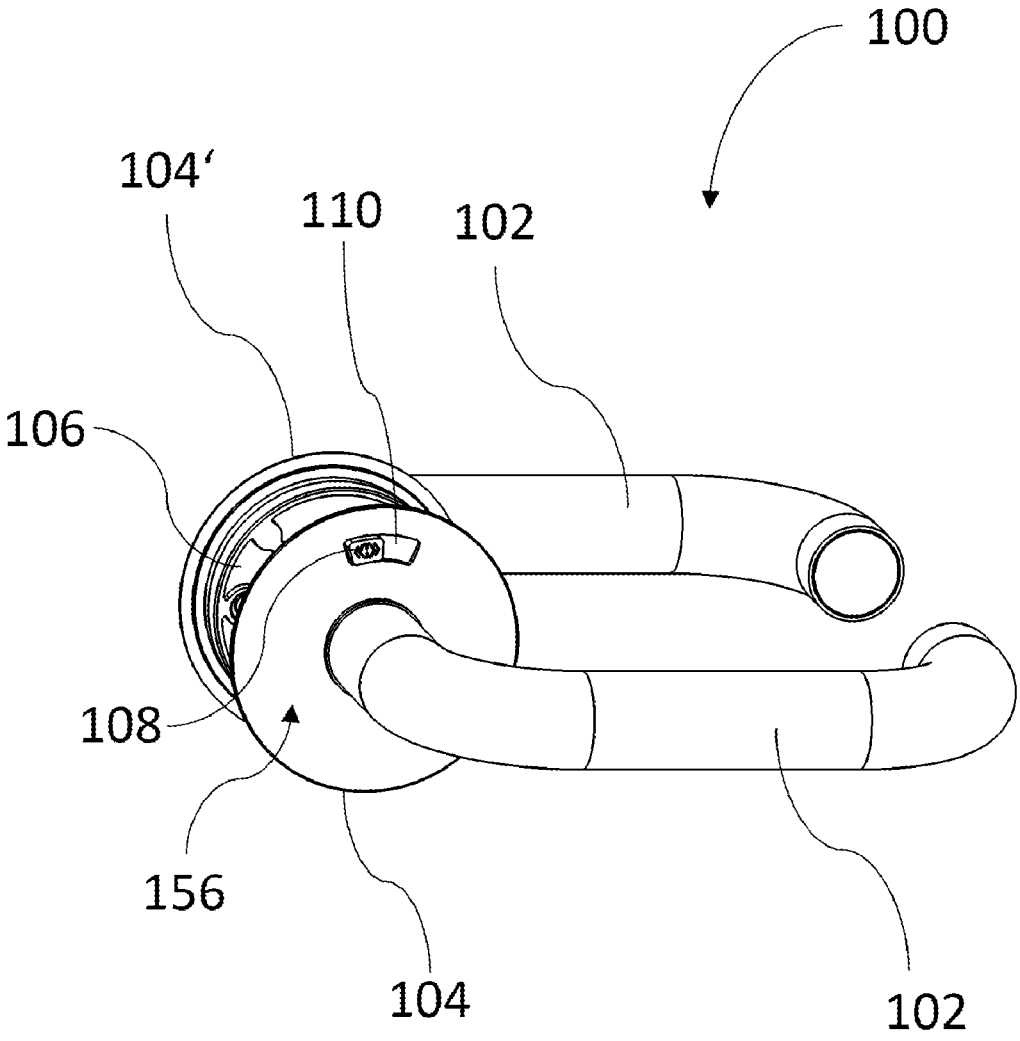

| | | | | |
|---|---|---|---|---|
| 4,861,084 | A | 8/1989 | Ozagir et al. | |
| 5,433,497 | A * | 7/1995 | Koenig | E05B 13/002 292/169.14 |
| 5,482,334 | A * | 1/1996 | Hotzl | E05B 53/00 292/142 |
| 5,826,924 | A * | 10/1998 | Huang | E05B 55/005 292/359 |
| 6,568,231 | B1 * | 5/2003 | Huang | E05B 13/004 292/358 |
| 6,644,077 | B1 * | 11/2003 | Huang | E05B 13/004 292/358 |
| 6,729,169 | B2 * | 5/2004 | Moore | E05B 63/0065 70/149 |
| 8,177,268 | B2 * | 5/2012 | Varney | E05B 13/00 292/297 |
| 9,982,455 | B2 * | 5/2018 | Badhya | E05B 55/005 |
| 2001/0027669 | A1 * | 10/2001 | Warmack | E05B 63/0004 70/257 |
| 2010/0199727 | A1 | 8/2010 | Varney et al. | |
| 2010/0225128 | A1 | 9/2010 | Engel et al. | |
| 2014/0191516 | A1 * | 7/2014 | Badhya | E05B 13/004 292/145 |
| 2015/0275544 | A1 * | 10/2015 | Karnutsch | E05B 15/0053 292/336.3 |
| 2020/0149317 | A1 * | 5/2020 | Seacat | E05B 9/02 |

FOREIGN PATENT DOCUMENTS

| | | | |
|---|---|---|---|
| GB | 141475 | A | 4/1920 |
| GB | 886906 | A | 1/1962 |

* cited by examiner

ACTUATING HANDLE WITH BLOCKING DEVICE

The invention relates to an actuating handle for a door according to the preamble of claim 1.

An actuating handle usually comprises at least one escutcheon which is arranged on a door leaf and is designed for the swiveling mounting of a handle such as a door knob. Often such actuating handles are required to be able to block an actuating of the handle by the user of the actuating handle when so needed, for example in order to lock a room. Many possible designs are known for this in the prior art, which either block a movement of the handle or decouple the movement of the handle from a closure mechanism provided in the door.

For example, DE 10 2007 030 655 A1 of the applicant describes one such actuating handle for a door, in which an escutcheon is arranged on either side of a door leaf. The escutcheon serves as a mount for a handle, which is connected by means of a square pin to a closure mechanism in the door leaf. In order to block the actuating of the handle and consequently the unlocking of the door when needed, a blocking device is formed between the escutcheons, which blocks a movement of the handle when a blocking element is actuated. The actuating member for the actuating of the blocking device is designed here as a swiveling element, which projects out from the end face of an escutcheon.

The design of an actuating handle with a blocking device for the actuating of the handle described in the aforementioned prior art has the drawback that the actuating member of the blocking device stands out by a distance from the end face of the escutcheon, resulting in a relatively large design height and consequently an appearance often perceived as unattractive. A reducing of the design height by a shortening of the actuating member would have the drawback of making it harder to hold the actuating member, making the actuating of the blocking device more difficult.

Accordingly, the problem which the present invention proposes to solve is to create an actuating handle with a blocking mechanism which is characterized by a low design height and at the same time is easy to operate.

In an actuating handle for a door with an escutcheon and a handle for actuating a locking device arranged in the door, wherein the handle for actuating the locking device is mounted in the escutcheon rotatably about a first axis of rotation, wherein the actuating handle moreover has a blocking device, wherein the blocking device has a release position in which a rotation of the handle about the first axis of rotation is released, and a blocking position in which a rotation of the handle about the first axis of rotation is blocked by the blocking device, wherein the actuating handle moreover has an actuating mechanism for the blocking device, it is provided according to the invention that the actuating mechanism has a sliding element which is displaceable along a circle segment centered around the first axis of rotation, wherein a displacement of the sliding element along the circle segment brings about an actuation of the blocking device.

By "actuation of the blocking device" is meant a process in which the blocking device is switched from the release position to the blocking position and vice versa.

The above described use of a sliding element which is displaceable along a circle segment centered about the axis of rotation of the handle has the advantage that the sliding element can be designed very flat, so that the overall design height of the escutcheon and especially that of the actuating mechanism of the blocking device can be kept low. At the same time, the use of such a sliding element has the advantage that its actuation is very easy and usually is possible with only one finger, especially in the style of the modern operation of mobile radio devices or tablet computers by swiping movements. On the contrary, the rotatable actuating member described above as the prior art must always be grasped by two fingers in order to guarantee a secure actuating.

Moreover, the design of the sliding element in the actuating handle according to the invention also makes it possible to actuate the handle and the sliding element with one hand at the same time and thus actuate the actuating mechanism with one finger of the same hand. Consequently, the handling of the design according to the invention of the actuating mechanism is also easier than in the prior art.

A compact construction of the actuating handle according to the invention is achieved in particular according to one embodiment if the sliding element passes through an end face of the escutcheon facing toward the handle in the direction of the first axis of rotation. By the end face is meant that surface which is arranged on the side of the escutcheon facing away from the door leaf and usually facing toward a user of the actuating handle. In this way, the escutcheon of an actuating handle according to the invention can have a very flat configuration, since the entire construction of the actuating mechanism can be recessed in the door leaf behind the escutcheon, and only the sliding element protrudes slightly from the surface of the escutcheon.

An actuating of the sliding element of the actuating mechanism is facilitated according to a further embodiment in that a surface of the sliding element protruding from the escutcheon is roughened. In this way, it is enough for a user of the actuating handle to merely place their finger on the sliding element and move the sliding element with slight pressure along the circle segment. The roughened surface of the sliding element will prevent the finger from slipping off the sliding element.

The actuating of the sliding element can be further simplified according to a further embodiment in that the escutcheon has a recess in its end face, through which the sliding element passes through the end face and in which the sliding element is guided. The recess preferably delimits the deflection of the sliding element along the circle segment. Consequently, the recess through which the sliding element passes through the end face of the escutcheon at the same time serves as a guide block for the sliding element. Moreover, the actuating mechanism may preferably be designed such that the release position of the blocking device is established on the side of a first end stop of the sliding element against the recess, while the blocking position of the blocking device is established on the side of a second end stop of the sliding element against the recess. This further simplifies the actuating of the sliding element, since for a secure actuating of the sliding element a user of the sliding element only has to move from one end of the recess to the other end of the recess and there is no doubt as to the position of the sliding element in which the release position or the blocking position of the blocking device is achieved.

According to a further embodiment, the blocking device comprises at least one first blocking element joined rotationally firmly to the handle and a second rotatably mounted blocking element, wherein a rotation of the second blocking element brings the second blocking element into engagement with the first blocking element such that a rotation of the handle about the first axis of rotation is hindered by the second blocking element. Thanks to this design, a blocking device can be realized with simple means requiring only a rotating of the second blocking element for the actuation, i.e., for a switching from a release position to a blocking position or vice versa.

In order to achieve a rotationally firm connection of the first blocking element to the handle of the actuating handle, the first blocking element may for example be shoved rotationally firmly onto a polygonal pin connected to the handle, which is provided for a coupling of the handle to a closure mechanism configured in a door leaf. The first blocking element may have a recess, for example, with which the second blocking element engages as soon as it has been moved into the blocking position.

According to a further embodiment it is provided that the actuating handle comprises two escutcheons, which are arranged on opposite sides of a door, wherein the actuating mechanism for the blocking device is arranged on a first escutcheon and wherein the blocking device is arranged between the first escutcheon and a second escutcheon. Consequently, the overall construction of the blocking device can be arranged on both sides of a door, which on the whole makes possible a relatively flat construction of the blocking device and hence that of the actuating handle. In particular, it may be provided that the blocking device is arranged on the second escutcheon.

According to a preferred embodiment, the actuating mechanism comprises a rotary slide and at least one pinion. The rotary slide is mounted on the escutcheon rotatably about the first axis of rotation and carries or comprises the sliding element. The pinion is mounted on the escutcheon rotatably about a second axis of rotation. The rotary slide stands in an operative connection with the pinion such that a rotation of the rotary slide about the first axis of rotation brings about an actuating of the blocking device from the release position to the blocking position and/or vice versa. Consequently, basically only two elements are needed for the design of the actuating mechanism of the blocking device, which can be arranged in space-saving manner beneath an escutcheon. This further contributes to a low design height of the actuating handle.

Preferably, the rotary slide is connected to the pinion such that a rotation of the rotary slide about the first axis of rotation brings about a rotation of the pinion about the second axis of rotation. The rotary slide is preferably a flat element, such as a metal plate, which lies flat against the back side of the escutcheon, so that a low design height results for the actuating mechanism.

According to a preferred embodiment, it is further provided that the maximum extension of the rotary slide is smaller in the radial direction of the first axis of rotation than the minimum extension of the first escutcheon. Consequently, the rotary slide never protrudes beyond the first escutcheon in the radial direction, regardless of its rotary position. Hence, the first escutcheon can be arranged completely flush with the surface of a door leaf, since no elements of the actuating device protrude in the radial direction beyond the first escutcheon.

The connection of the rotary slide to the pinion is preferably realized according to a further embodiment in that the rotary slide comprises a toothed segment on its circumference, which meshes with the pinion. For example, the rotary slide as already mentioned above can be a flat metal plate, in which teeth are provided in one region of the circumference, preferably designed in the shape of a circle segment, being matched in shape to the teeth of the pinion.

According to a preferred embodiment, the toothed segment is arranged on the rotary slide diagonally opposite the sliding element with respect to the first axis of rotation. In this way, a large lever can be realized between the sliding element and the toothed segment of the sliding element, which makes easier an actuating of the sliding element and hence an actuating of the blocking device. The circle segment of the sliding element in which the toothed segment is formed is preferably likewise centered about the first axis of rotation, so that a secure engaging of the teeth of the toothed segment with the teeth of the pinion can be assured.

Moreover, the actuating of the sliding element according to another embodiment can be simplified in that the size of the pinion and the toothed segments are attuned to each other such that a rotation of the rotary slide by 15° to 25°, preferably 20°, about the first axis of rotation brings about a rotation of the pinion by 90° about the second axis of rotation. In this way, a rotation of the pinion and hence a rotation of the second blocking element can be accomplished already with a slight displacement travel of the sliding element, which is enough to switch the blocking element between the release position and the blocking position. This further facilitates the handling of the sliding element, since only a slight effort is needed to actuate the sliding element.

The transmitting of the rotation of the pinion to the second blocking element preferably occurs, according to a further embodiment, in that the pinion and the blocking device are joined together rotationally firmly by a shaft. Preferably, the blocking element of the blocking device is mounted on the shaft. It is further provided according to another embodiment that the pinion is arranged on a first bushing and the second blocking element on a second bushing, wherein the shaft engages with the first and second bushing and is mounted floating in the first and second bushing. The floating mounting of the shaft in the bushings has the advantage that the distance between pinion and second blocking element can be chosen to be variable, yet even so a secure coupling of the pinion with the second blocking element is achieved. In particular, in one embodiment, in which the second blocking element is arranged on a first escutcheon and the pinion on a second escutcheon, the actuating handle can thus be adapted to different thicknesses of a door on which the actuating handle is to be mounted. The pinion or the second blocking element can either be mounted or fastened on the respective bushings, or be designed as a single piece with the corresponding bushings. In particular, a single-piece design of the pinion/second blocking element with the corresponding bushing has the advantage that a good stability of the actuating mechanism is achieved in general.

Preferably the shaft here is a polygonal pin, especially a square pin.

In order to make possible an unlocking of the blocking device even without actuating the sliding element, it is provided according to a further embodiment that the second bushing passes through the second escutcheon along the second axis of rotation and has a receptacle for a tool. By a tool receptacle is meant a receptacle for a screwdriver with plain slot, Phillips head, or hexagon. Thus, by inserting a corresponding tool, a rotation of the second blocking element can be accomplished, so that the blocking device can be unlocked. Preferably the tool receptacle is arranged in an escutcheon in which the sliding element is also not arranged at the same time. Thus, for example, a door locked on the inside can be opened from the other side of the door, for example in the case when a person has unintentionally become locked in.

In order to further simplify the actuating of the sliding element by a user of the actuating handle, it is provided according to a further embodiment that the first escutcheon comprises a guide ring on its back side, on which the rotary slide is rotatably mounted. The guide ring here preferably forms a latching device with the rotary slide, which presents an increased resistance to a rotation of the rotary slide in at least two rotary positions of the rotary slide. In this way, a user is given sensory feedback upon actuating the sliding element when the sliding element has moved the blocking device into the release position, or into the blocking position.

The latching device according to a further embodiment is designed such that the actuating mechanism comprises a lock ring, which is arranged rotationally firmly on the guide ring, wherein the rotary slide is arranged rotatably on the lock ring. The lock ring has at least one locking lug, which engages with corresponding mating recesses of the rotary slide at the at least two rotary positions of the rotary slide. For example, the lock ring may simply be mounted on the guide ring, with the lock ring engaging in corresponding recesses of the guide ring or vice versa. It may also be provided that the locking lug is arranged in the rotary slide and the mating recesses are formed in the lock ring.

Moreover, it can be provided according to a further embodiment that the actuating mechanism comprises a mounting element which is fastened to the first escutcheon and fixes the rotary slide in the axial direction of the first axis of rotation on the guide ring. In this way, no separate fixation of the rotary slide on the guide ring is necessary. Moreover, with the use of a mounting element the entire construction of rotary slide, lock ring and guide ring can be fixed in its position such that no further fastening means are required. This further simplifies the overall construction of the actuating mechanism. The rotary slide is arranged preferably as a flat element, such as a metal plate, between the mounting element and the first escutcheon.

Preferably the mounting element according to a further embodiment is secured on the first escutcheon by means of at least two fastening bushings, wherein the fastening bushings each have at least one flange. The mounting element is then held by force locking of the mounted fastening bushings between the flanges and the first escutcheon. According to a further embodiment, it is provided that the fastening bushings are designed so as to engage with mating elements of the second escutcheon, and the engagement produces a floating mounting. Consequently, the fastening bushings according to the above described embodiment play a dual role. On the one hand, the fastening bushings serve to secure the mounting element on the first escutcheon and consequently to fasten the overall actuating mechanism to the first escutcheon. On the other hand, the fastening bushings serve at the same time for a floating mounting of the first escutcheon on the second escutcheon, so that the spacing between escutcheons arranged on different sides of a door leaf can be adapted to the thickness of the door leaf.

Figure 2:
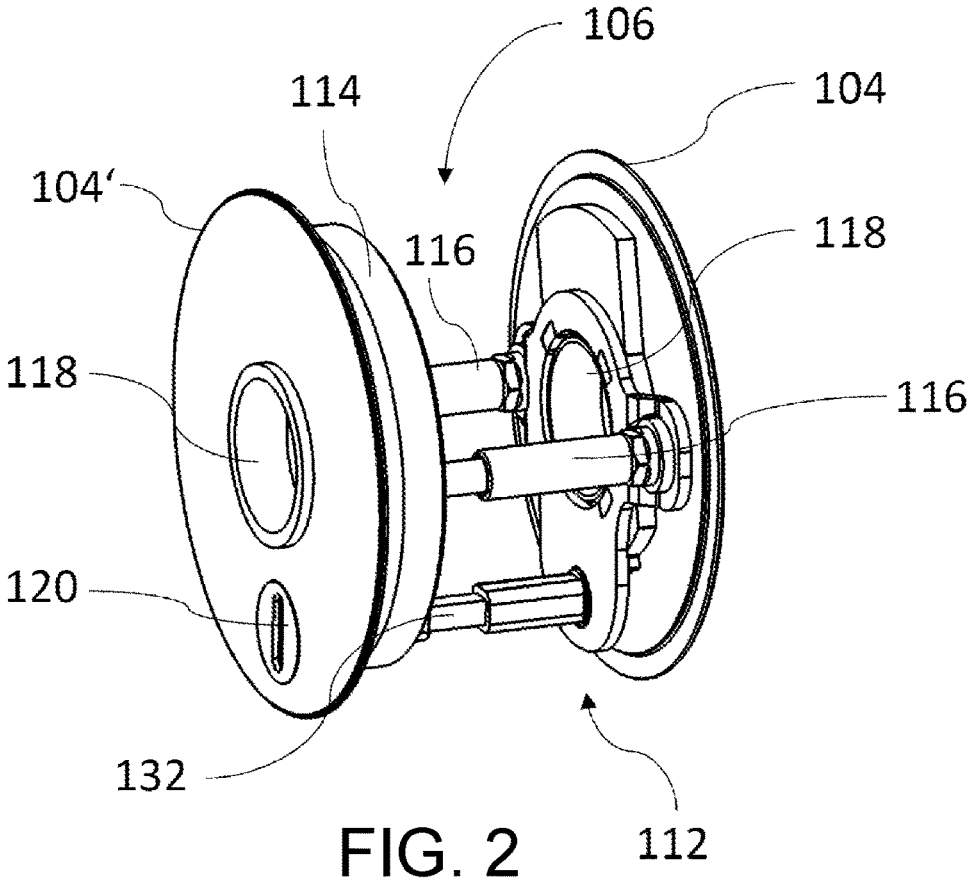
Figure 3:
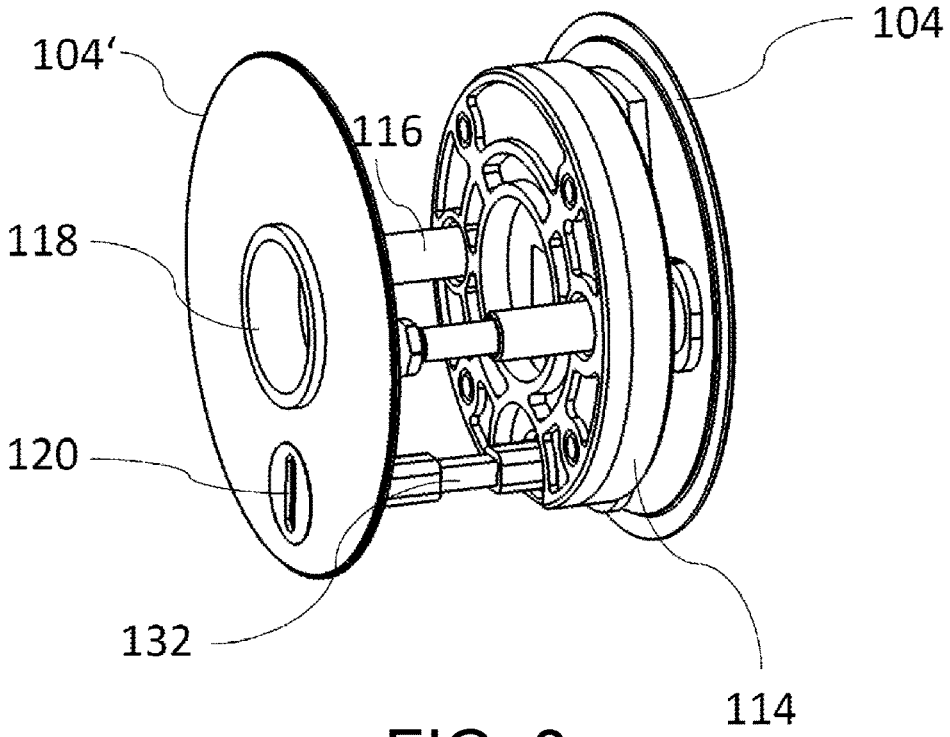
Figure 4:
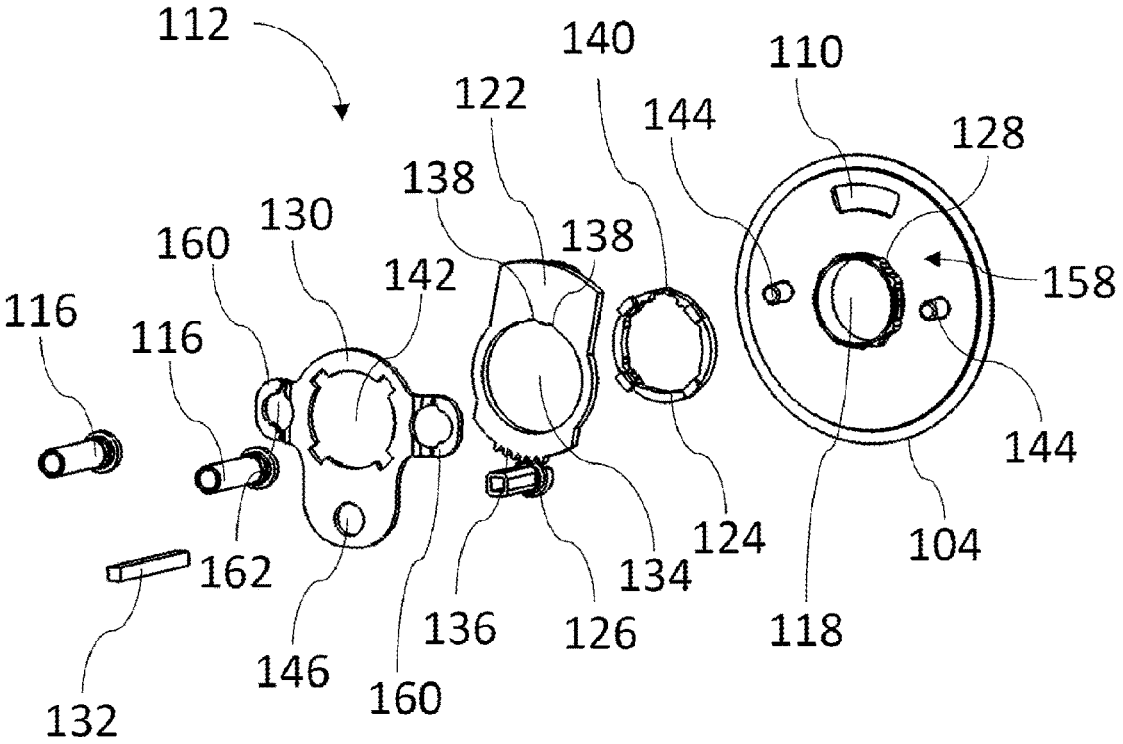
Figure 5:
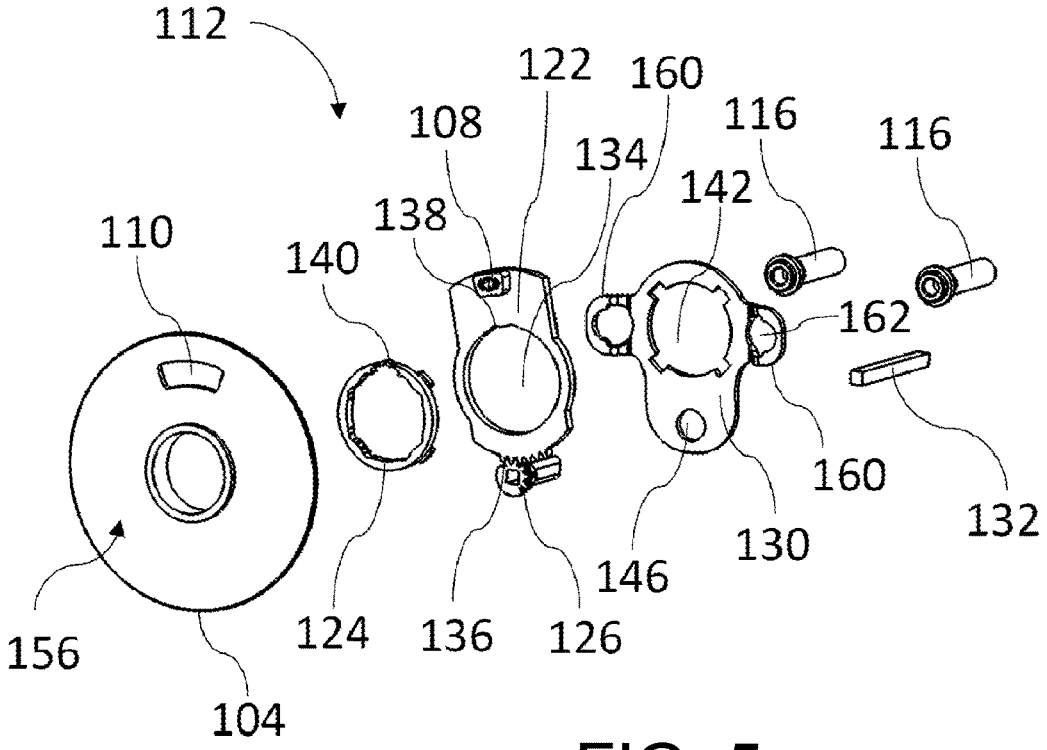
Figure 6:
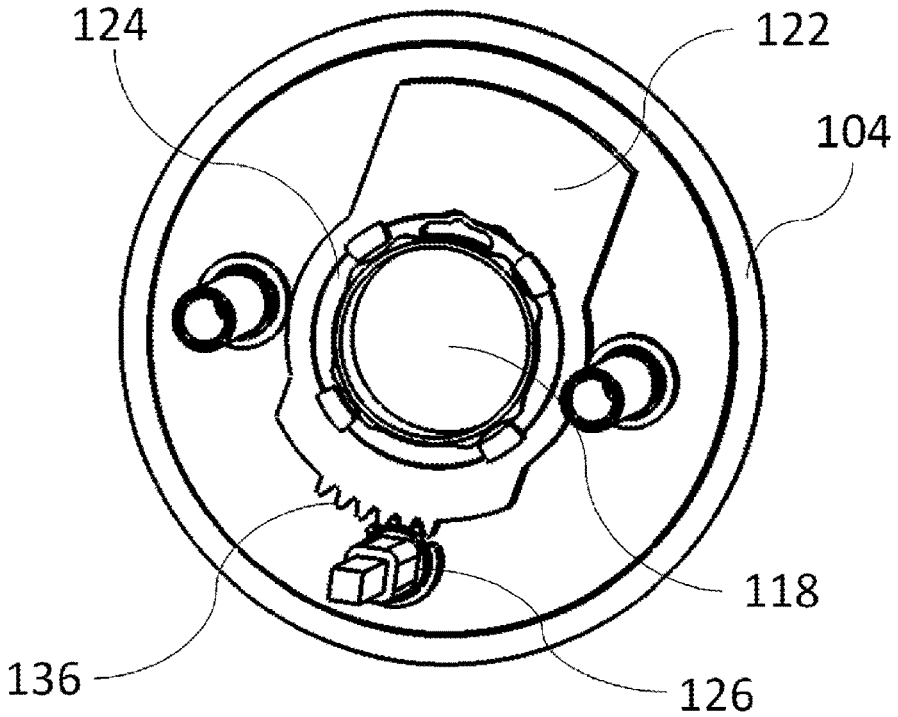
Figure 7:
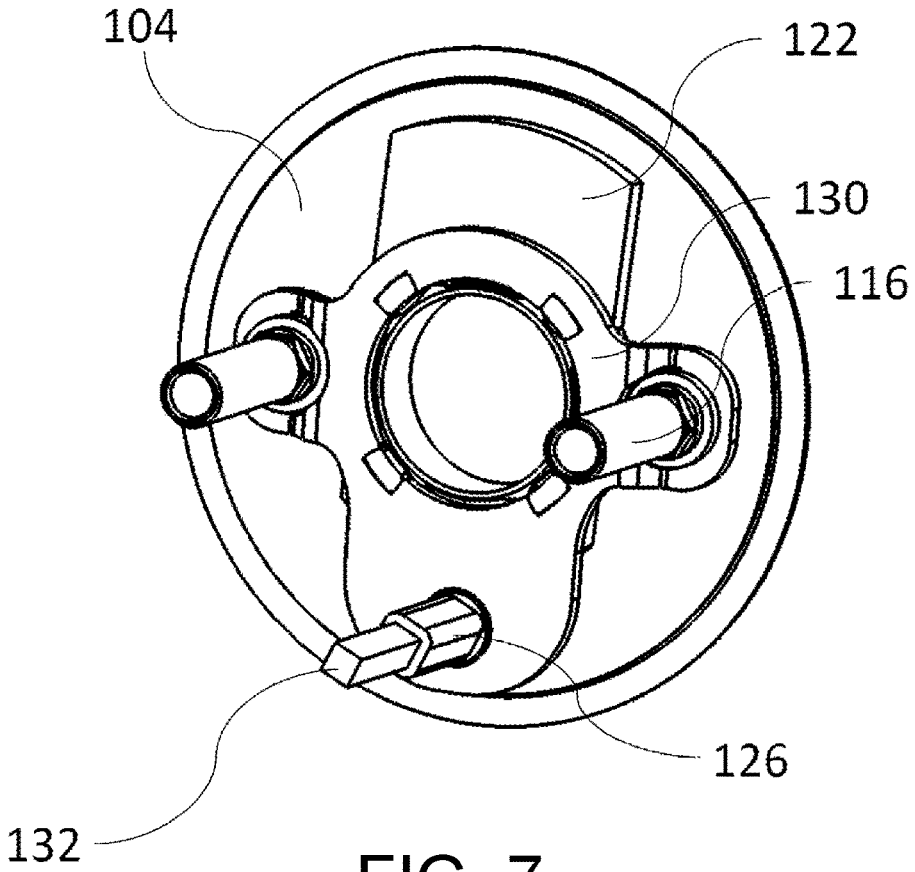
Figure 8:
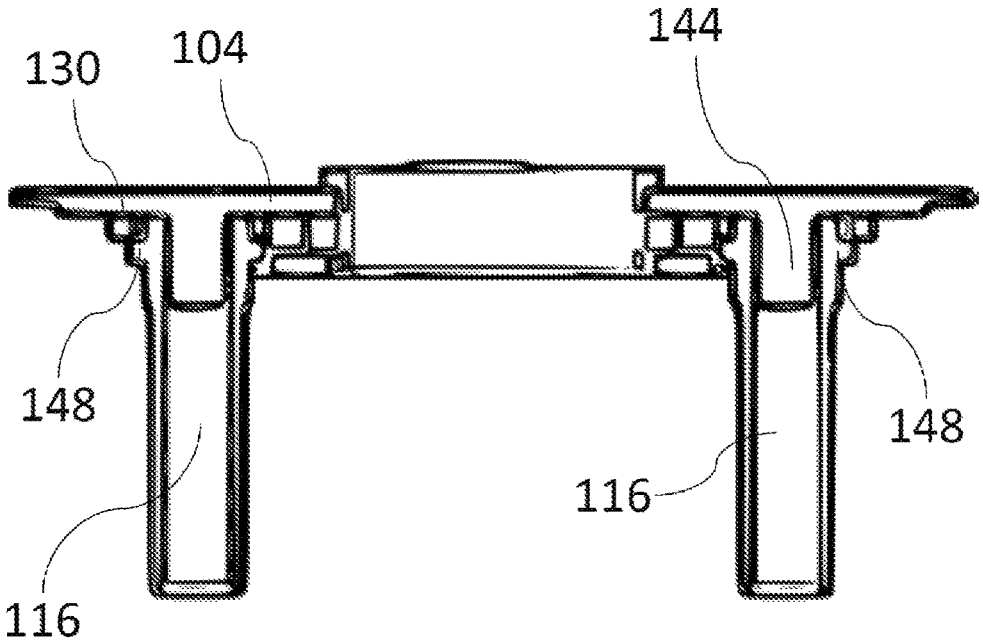
Figure 9:
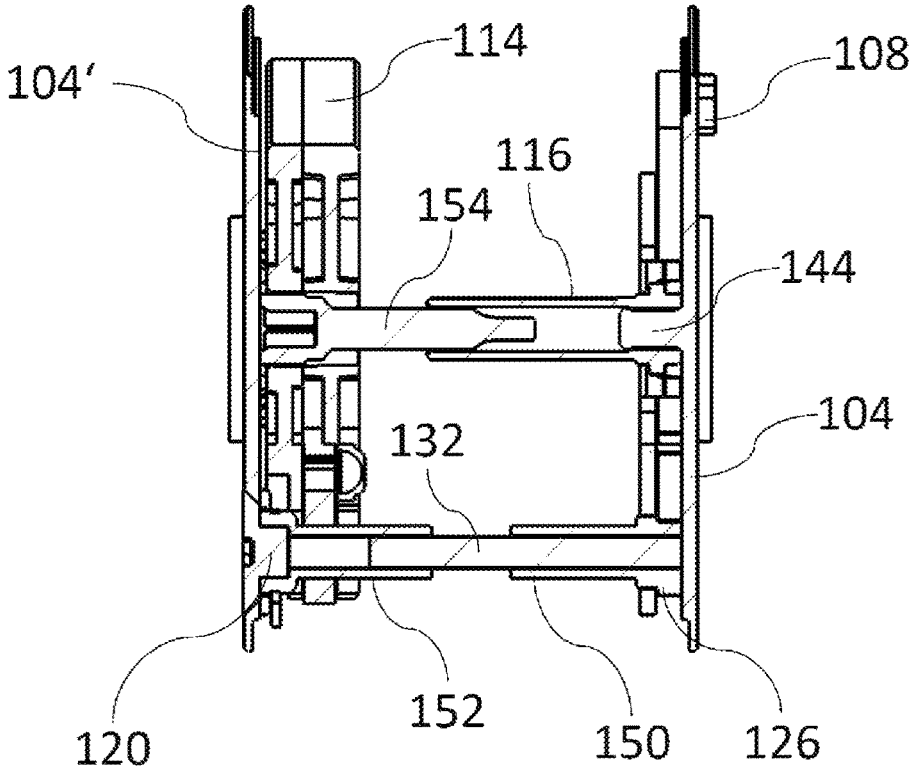

Further features, details and benefits of the invention will emerge from the wording of the claims as well as the following description of exemplary embodiments with the aid of the drawings. There are shown:

FIG. 1 a perspective view of an actuating handle,

FIG. 2 a perspective view of a blocking device arranged between the escutcheons, FIG. 3 a perspective view of an alternative arrangement of the blocking device between the escutcheons, FIG. 4 an exploded view of the actuating mechanism, FIG. 5 an exploded view of the same actuating mechanism from a different viewing direction, FIG. 6 a schematic view of an actuating mechanism arranged on an escutcheon, FIG. 7 a further view of FIG. 6 with a mounting element, FIG. 8 a sectional view of a top view of an actuating mechanism arranged on an escutcheon, and FIG. 9 a further sectional view of an actuating handle.

In the following, similar or identical features shall be given the same reference numbers.

FIG. 1 shows a perspective view of an actuating handle 100 with two handles 102, two escutcheons 104, 104' and a recognizably indicated blocking device 106. The actuating handle 100 shown may be arranged for example on a door leaf. For this, at first the escutcheons 104, 104' are arranged on both sides of a door leaf, and the blocking device 106 is arranged between the escutcheons 104, 104'. After this, the handles 102 are secured to the escutcheons 104, 104'. For this, a polygonal pin for example is passed through corresponding recesses of the escutcheons 104, 104' and a mortise lock (not shown) arranged in the door leaf. Then the handles 102 are fastened rotationally firmly to the polygonal pin. By actuating the handles 102, it is then possible to actuate the mortise lock, so that a bolt of the mortise lock is pulled out from a corresponding door latch and the door can be opened. In the example shown in FIG. 1, the escutcheons 104, 104' are disk-shaped escutcheons in which the handles 102 are mounted centrally.

For such actuating mechanisms of actuating handles there is often provided a mechanism which blocks an actuation of the handle 102 when need be, so that an opening of the door on which the handle 102 is arranged is no longer possible. This is realized in the actuating handle 100 according to the invention in that the blocking device 106 hinders the polygonal pin on which the handles 102 are fastened from rotating about its longitudinal axis. The switching between this position, hereafter called the "blocking position", and a position in which the handles 102 can be actuated, hereafter called the "release position", occurs in the actuating handle 100 according to the invention by a user actuating the sliding element 108. The sliding element 108 is an element preferably roughened on its surface, sticking out from one end face 156 of a first escutcheon 104. The sliding element 108 is preferably dimensioned such that only a few millimeters stick out beyond the end face 156, such as 1 to 5 mm.

The sliding element 108 is mounted in the first escutcheon 104 such that it can be displaced along a circle segment centered about the axis of rotation of the handle 102 or a square pin connected to the handle. For this, the first escutcheon 104 moreover has a recess 110, in which the sliding element 108 is guided. By a deflecting of the sliding element 108 inside the recess 110, a switching is then possible between the blocking position and the release position of the blocking device 106. As is moreover evident from FIG. 1, the recess 110 allows a displacement of the sliding element 108 along the circle segment in an angle range of around 20°. In the embodiment shown, the recess 110 acts at the same time as an end stop for the sliding element 108 and thereby limits a possible displacement of the sliding element 108 along the circle segment. Preferably, the end positions of the sliding element 108 in the recess correspond to the release and blocking positions.

FIG. 2 shows a perspective view of the internal design of the actuating handle 100. The handles 102 represented in FIG. 1 are not shown here, for reasons of clarity. As can be seen readily in FIG. 2, the blocking device 106 and an actuating mechanism 112 for the blocking device 106 are formed between the escutcheons 104 and 104'. The actuating mechanism 112 is substantially arranged on the first escutcheon 104 depicted on the right side, while the blocking device 106 is formed in a closure tablet 114 on the opposite side on the second escutcheon 104' depicted at the left side. The blocking device 106 formed in the closure tablet 114 is a mechanism which can be switched by a corresponding actuation between a blocking position and a release position, as was described above. The precise functioning of the blocking device 106 will not be discussed at this time. Instead, as an example of this, refer to the above cited other application of the applicant, in which the functioning of such a closure tablet 114 has already been described.

Moreover, in FIG. 2 it is readily apparent that the second escutcheon 104' is connected by corresponding connecting means to the first escutcheon 104. The connecting means are, on the one hand, fastening bushings 116, which are arranged at the side next to a recess 118, in which a handle 102 can be mounted in the first escutcheon 104. These fastening bushings 116 engage with mating elements which are arranged on the opposite second escutcheon 104'. The mating elements are mounted floating in the fastening bushings 116, so that the distance between the first escutcheon 104 and the second escutcheon 104 is adjustable in flexible manner. Moreover, beneath the recess 118 there is formed another connection between the escutcheons 104, 104', which shall be further discussed below.

FIG. 3 shows the same cutout feature as FIG. 2, but in this instance the closure tablet 114 like the actuating mechanism 112 is arranged on the first escutcheon 104. The question of which escutcheon 104, 104' should be used to arrange the closure tablet 114 depends in most instances on the layout of the mortise lock as well as the corresponding recesses in the door leaf. In theory, the closure tablet 114 can be arranged in any desired position between the two escutcheons 104 and 104' by an appropriate configuration of the actuating mechanism 112. In this way, the described actuating handle 100 can be adapted in flexible manner to the prevailing conditions of the installation.

FIGS. 2 and 3 moreover reveal that a receptacle 120 for a tool is provided in the second escutcheon 104' arranged on the left side, being in this instance a slotted screwdriver. This is located beneath the recess 118 for a handle 102. By inserting a tool into the receptacle 120 and rotating the receptacle 120, the closure tablet 114 can be moved from a blocking position to a release position or vice versa, without having to actuate the actuating mechanism 112 by means of the sliding element 108. Thus, an unlocking of a door can also be done when the sliding element 108 is not accessible to a user. This may be helpful, for example, if a person is unintentionally locked in by actuating the sliding element 108 and then is no longer able to unlock the door. The precise functioning or interacting of the closure tablet 114 with the receptacle 120 or the actuating mechanism 112 shall now be discussed.

For this, FIG. 4 shows an exploded view of the actuating mechanism 112 with an escutcheon 104, on which the actuating mechanism 112 can be arranged. Basically, the actuating mechanism 112 consists of a flat rotary slide 122, a lock ring 124, a pinion 126 and a guide ring 128, which is arranged around the recess 118 on the back side 158 of the escutcheon 104. Moreover, the exploded view of FIG. 4 shows a mounting element 130, two fastening bushings 116 and a shaft 132 configured as a square pin.

The escutcheon 104 here has the recess 110 provided for the guiding of the sliding element 108 in its upper area. The recess 110 is configured as a circle segment, which is centered around the center of the recess 118 and hence around the later axis of rotation of the installed handle 102. To the side of the recess 118 of the escutcheon 104 there are formed moreover two pins 144, whose function shall be explained later on. The pins 144 may be threaded pins, for example.

The rotary slide 122 is configured as a substantially flat plate, in the center of which an approximately round circular recess 134 is formed, which is larger in its diameter than the recess 118 of the escutcheon 104. In the assembled condition of the actuating mechanism 112, the rotary slide lies with its back side against the back side 158 of the escutcheon 104. Above the recess 134 on the back side of the rotary slide 122 there is provided the sliding element 108, which is preferably designed as a single piece with the rotary slide 122. The sliding element 108 is particularly well seen in FIG. 5, where the exploded view of FIG. 4 is shown from the opposite direction. On the diagonally opposite end of the rotary slide 122 there is formed moreover a toothed segment 136, which is arranged on a circle segment being centered about the center of the recess 134. The toothed segment 136 is designed to engage with a corresponding toothing of the pinion 126. In this way, a rotation of the sliding element 122 about the center of the recess 134 is transmitted to the pinion 126, which then rotates about a second axis of rotation, corresponding to the longitudinal axis of the pinion 126.

The recess 134 of the rotary slide 122 has at its upper circumference two recesses in the form of notches 138. These are designed to form with the lock ring 124 a latching device, which presents an increased resistance to a rotation of the rotary slide 122 for defined positions of the rotary slide 122 relative to the lock ring 124. For this, a locking lug 140 is provided on the lock ring 124, which can engage with the notches 138. At the same time, the lock ring 124 serves as a rotary bearing for the rotary slide 122. For this, the lock ring 124 may be secured rotationally firmly to the guide ring 128. For this purpose, the guide ring 128 has fastening lugs on its circumference, which engage with corresponding recesses of the lock ring 124 when it is mounted on the guide ring 128.

For the assembly of the actuating mechanism 112, basically at first the lock ring 124 is mounted on the guide ring 128 and then the rotary slide 122 is mounted on the lock ring 124. The centers of the respective recesses of the elements line up in this process and all of them lie on a common first axis of rotation, which at the same time corresponds to the axis of rotation about which the one handle 102 mounted in the escutcheon 104 can rotate.

For the fastening of the rotary slide 122 on the lock ring 124, the mounting element 130 is further provided. This is substantially a flat metal sheet with two curved wings 160 arranged at the sides, having a total of four recesses. A first central recess 142 is arranged centrally between the wings 160 such that their midpoint, after being assembled, coincides with the first axis of rotation. Moreover, notches are provided at the sides of the first recess 142, which can engage with corresponding mating elements of the guide ring 124, so that the guide ring 124 can no longer rotate relative to the mounting element 130 once the mounting element 130 is brought into engagement with the guide ring 124.

Beneath the recess 142 there is provided a further recess 146, which serves to receive and support the pinion 126. Moreover, at the side of the recess 142 there are provided further recesses 162 in the wings 160, which serve for the fastening of the mounting element 130 on the escutcheon 104, as will be further explained below.

FIG. 6 shows the result of a first partial step in the assembly of the actuating mechanism 112. Here, first of all the lock ring 124 was mounted on the guide ring 128. Next, the rotary slide 122 was mounted on the lock ring 140 and the pinion 126 was arranged beneath the rotary slide 122 such that the toothed segment 136 engages with the toothing of the pinion 126, i.e., meshes with it. In the condition of the assembly process shown in FIG. 7, moreover the mounting element 130 has been mounted on the lock ring 124, so that a rotation of the lock ring 124 is blocked by the corresponding recesses in the recess 142 of the mounting element 130. Moreover, the fastening bushings 116 have been placed on the pins 144 passing through the side recesses 162 and through the mounting element 130, so that the mounting element 130 is secured on the escutcheon 104.

In this condition, the rotary slide 122 can no longer be displaced along the first axis of rotation, but only rotated about this first axis of rotation. Upon rotating the rotary slide 122 about the first axis of rotation, because of the toothed segment 136, the rotation of the rotary slide 122 is transmitted to the pinion 126, which in this way rotates about a second axis of rotation. The pinion is led here through the recess 146 of the mounting element 130. The rotating of the pinion 126 about the second axis of rotation is transmitted by means of the square pin 132 to the blocking mechanism of the closure tablet 114. This shall be further explained below with reference to FIG. 9. The distance between the first axis of rotation and the second axis of rotation can be for example 21.5 mm.

FIG. 8 shows yet again a top view of the object of FIG. 7, showing moreover a cross section through the fastening bushings 116. It can be seen that the fastening bushings are mounted on the pins 144 and thus fixed at the escutcheon. Moreover, an encircling flange 148 is formed on the fastening bushings 116 near the escutcheon 104. The mounting element 130 is clamped between this flange 148 and the escutcheon 104 when the fastening bushings 116 are mounted on the pins 144. The mounting element 130 rests only with the curved wings 160 against the back side 158 of the escutcheon 104. Thanks to the S-shape curved form of the wings, a space is formed between the escutcheon 104 and the mounting element 130, in which the rotary slide 122 is arranged.

The fastening bushings 116, as already mentioned above, are designed here at the same time for mounting a mating element of an oppositely situated escutcheon 104. Consequently, the fastening bushings 116 play a dual role, since on the one hand they serve for securing the mounting plate 130 at the escutcheon 104 and on the other hand produce a connection of a first escutcheon 104 to an oppositely situated escutcheon 104.

This dual role is well seen in FIG. 9, where the overall construction that was previously discussed is once more represented in a lateral cross section view. It can clearly be seen that the actuating mechanism 112 and especially the fastening bushings 116 as well as the pinion 126 are arranged at the right-hand first escutcheon 104. Both the fastening bushings 116 and the pinion 126 are designed to receive a connection element. For this, the pinion 126 is formed on a first bushing 150, which has a receiving space for a connection element 132. The connection element is the square pin 132, which is mounted floating in the bushing of the pinion 126. On the oppositely situated second escutcheon 104' there is arranged a mating second bushing 152, with which the square pin 132 likewise engages. The second bushing 152 is connected to the closure tablet 114 such that a rotation of the second bushing 152 brings about an actuating of the blocking mechanism formed in the closure tablet 114. Moreover, the receptacle 120 for a tool is formed at the left side of the second bushing 152 and connected rotationally firmly to this bushing. The second receiving element 104' passes through the receptacle 120, so that the blocking mechanism can be actuated from this side.

Moreover, connecting pins 154 are arranged on the second escutcheon 104', which engage with the fastening bushings 116 and thus establish the relative position of the second escutcheon 104' to the first escutcheon 104. The escutcheons 104, 104' can be displaced relative to each other along the first axis of rotation, making possible an adapting of the actuating handle 100 to the thickness of a door or a door leaf.

The above described design of the actuating handle 100 makes it possible to arrange the entire mechanism of the blocking device in a door leaf, so that the escutcheons 104, 104' can terminate smoothly with the surface of a door leaf. Only the sliding element 108 for actuating the blocking device 106, besides the handles 102 themselves, protrudes out from the first escutcheon 104. Thus, an overall very compact appearance results, since only a few elements protrude from the door leaf.

The invention is not confined to one of the above described embodiments, but instead can be modified in diverse ways. However, it will be evident that an actuating handle 100 for a door contains an escutcheon 104 and a handle 102 for actuating a locking device arranged in the door. The handle 102 for actuating the locking device is mounted in the escutcheon 104 rotatably about a first axis of rotation. The actuating handle 100 moreover has a blocking device 106, having a release position in which a rotation of the handle 102 about the first axis of rotation is released, and a blocking position, in which a rotation of the handle 102 about the first axis of rotation is blocked by the blocking device 106. The actuating handle 100 moreover has an actuating mechanism 112 for the blocking device 106. According to the invention, it is proposed that the actuating mechanism 112 has a sliding element 108 which is displaceable along a circle segment centered around the first axis of rotation, wherein a displacement of the sliding element 108 along the circle segment brings about an actuation of the blocking device 106

For example, the sliding element 108 may also be arranged at the side or underneath the recess 118 to receive the handles 102. Moreover, the invention is not necessarily reliant on the described force transmission between the rotary slide 122 and the pinion 126 by means of a gear mechanism. Instead, other transmission options are also perfectly conceivable. The described specific design of the latching mechanism can also be modified so that the locking lug is arranged on the rotary slide 122, while the mating recesses are provided in the lock ring 124.

All features and advantages emerging from the claims, the specification, and the drawing, including structural details, spatial arrangements, and method steps, may be significant to the invention both in themselves and also in the most varied combinations.

List of reference numbers

| | | | |
|---|---|---|---|
| 100 | Actuating handle | 112 | Actuating mechanism |
| 102 | Handle | 114 | Closure tablet |
| 104 | First escutcheon | 116 | Fastening bushing |
| 104' | Second escutcheon | 118 | Recess |
| 160 | Blocking device | 120 | Receptacle |
| 108 | Sliding element | 122 | Rotary slide |
| 110 | Recess | 124 | Lock ring |
| 126 | Pinion | 146 | Recess |

-continued

| List of reference numbers | | | |
|---|---|---|---|
| 128 | Guide ring | 148 | Flange |
| 130 | Element | 150 | First bushing |
| 132 | Shaft/Square pin | 152 | Second bushing |
| 134 | Recess | 154 | Connecting pin |
| 136 | Toothed segment | 156 | End face |
| 138 | Recess/Notch | 158 | Backside |
| 140 | Locking lug | 160 | Wing |
| 142 | Recess | 162 | Recess |
| 144 | Pin | | |

The invention claimed is:

1. An actuating handle for a door with a first escutcheon and a handle for actuating a locking device arranged in the door, wherein the handle for actuating the locking device is mounted in the first escutcheon rotatably about a first axis of rotation, wherein the actuating handle moreover has a blocking device, wherein the blocking device has a release position in which a rotation of the handle about the first axis of rotation is released, and a blocking position in which a rotation of the handle about the first axis of rotation is blocked by the blocking device, wherein the actuating handle moreover has an actuating mechanism for the blocking device, wherein the actuating mechanism has a sliding element which is displaceable along a circle segment centered around the first axis of rotation, wherein a displacement of the sliding element along the circle segment brings about an actuation of the blocking device;

wherein the sliding element passes through an end face of the first escutcheon facing toward the handle in the direction of the first axis of rotation;

wherein the actuating mechanism comprises a rotary slide and at least one pinion, wherein the rotary slide is mounted on the first escutcheon rotatably about the first axis of rotation and carries or comprises the sliding element, wherein the pinion is mounted on the first escutcheon rotatably about a second axis of rotation, and wherein the rotary slide stands in an operative connection with the pinion such that a rotation of the rotary slide about the first axis of rotation brings about an actuating of the blocking device from the release position to the blocking position and/or vice versa;

wherein the pinion and the blocking device are joined together rotationally firmly by a shaft; and wherein the pinion is arranged on a first bushing and a second blocking element on a second bushing wherein the shaft engages with the first and second bushing and is mounted floating in the first and second bushing.

2. The actuating handle as claimed in claim 1, wherein the first escutcheon has a recess in its end face, through which the sliding element passes through the end face and in which the sliding element is guided.

3. The actuating handle as claimed in claim 1, wherein the blocking device comprises at least one first blocking element joined rotationally finnly to the handle and the second blocking element, the second blocking element being rotatably mounted, wherein a rotation of the second blocking element brings the second blocking element into engagement with the first blocking element such that a rotation of the handle about the first axis of rotation is hindered by the second blocking element.

4. The actuating handle as claimed in claim 1, wherein the actuating handle further includes a second escutcheon, the first and second escutcheons can be arranged on opposite sides of a door, wherein the actuating mechanism for the blocking device is arranged on the first escutcheon and wherein the blocking device is arranged between the first escutcheon and the second escutcheon.

5. The actuating handle as claimed in claim 1, wherein the maximum extension of the rotary slide is smaller in the radial direction of the first axis of rotation than the minimum extension of the first escutcheon.

6. The actuating handle as claimed in claim 1, wherein the rotary slide comprises a toothed segment on its circumference, which meshes with the pinion.

7. The actuating handle as claimed in claim 1, wherein the second bushing passes through the second escutcheon along the second axis of rotation and has a receptacle for a tool.

8. The actuating handle as claimed in claim 1, wherein the first escutcheon comprises a guide ring on its back side, on which the rotary slide is rotatably mounted.

9. The actuating handle as claimed in claim 8, wherein the guide ring forms a latching device with the rotary slide, which presents an increased resistance to a rotation of the rotary slide in at least two rotary positions of the rotary slide.

10. The actuating handle as claimed in claim 9, wherein the actuating mechanism comprises a lock ring, which is arranged rotationally firmly on the guide ring, wherein the rotary slide is arranged rotatably on the lock ring and wherein the lock ring has at least one locking lug, which engages with corresponding mating recesses of the rotary slide at the at least two rotary positions of the rotary slide.

11. The actuating handle as claimed in claim 9, wherein the actuating mechanism comprises a mounting element which is fastened to the first escutcheon and. fixes the rotary slide in the axial direction of the first axis of rotation on the guide ring.

* * * * *